US011071922B2

(12) United States Patent
Hall et al.

(10) Patent No.: US 11,071,922 B2
(45) Date of Patent: Jul. 27, 2021

(54) ROTATING PLATFORM COASTER

(71) Applicant: Universal City Studios LLC, Universal City, CA (US)

(72) Inventors: Gregory S. Hall, Orlando, FL (US); Keith Michael McVeen, Winter Garden, FL (US)

(73) Assignee: Universal City Studios LLC, Universal City, CA (US)

( * ) Notice: Subject to any disclaimer, the term of this patent is extended or adjusted under 35 U.S.C. 154(b) by 0 days.

(21) Appl. No.: 16/696,653

(22) Filed: Nov. 26, 2019

(65) Prior Publication Data

US 2020/0306655 A1 Oct. 1, 2020

Related U.S. Application Data

(60) Provisional application No. 62/827,690, filed on Apr. 1, 2019.

(51) Int. Cl.
*A63G 31/14* (2006.01)

(52) U.S. Cl.
CPC ..... *A63G 31/14* (2013.01)

(58) Field of Classification Search
CPC ..... A63G 31/14; A63G 33/00; A63G 31/02; A63G 31/00; A63G 7/00; A63G 1/26; A63G 1/24; A63G 1/48; A63G 1/00; A63G 1/08; A63G 1/10; A63G 1/06; A63G 31/04; A63G 31/10
USPC ..... 472/47
See application file for complete search history.

(56) References Cited

U.S. PATENT DOCUMENTS

| | | | | |
|---|---|---|---|---|
| 1,549,927 | A | 8/1925 | Sherry | |
| 6,220,965 | B1 * | 4/2001 | Hanna | A63G 7/00 463/52 |
| 6,269,750 | B1 | 8/2001 | Cornwell et al. | |
| 8,066,576 | B2 | 11/2011 | Threlkel | |
| 8,162,768 | B2 * | 4/2012 | Nemeth | A63G 1/24 472/39 |
| 8,313,389 | B2 * | 11/2012 | Crawford | A63G 1/06 472/41 |
| 8,393,275 | B2 | 3/2013 | Jacobi et al. | |
| 8,641,540 | B2 | 2/2014 | Feuer et al. | |
| 9,272,224 | B2 | 3/2016 | Nemeth et al. | |
| 10,086,300 | B1 * | 10/2018 | Suttell | G06T 19/003 |
| 2006/0154735 | A1 * | 7/2006 | Zamperla | A63G 1/30 472/39 |

(Continued)

FOREIGN PATENT DOCUMENTS

| | | |
|---|---|---|
| EP | 2301637 | 3/2011 |
| WO | 2015/040195 | 3/2015 |

OTHER PUBLICATIONS

PCT/US2020/024207 International Search Report and Written Opinion dated Jun. 9, 2020.

(Continued)

*Primary Examiner* — Michael D Dennis
(74) *Attorney, Agent, or Firm* — Fletcher Yoder P.C.

(57) ABSTRACT

An apparatus for an amusement park includes a bogie system that moves along a ride path, a platform coupled to the bogie system, and a plurality of seats coupled to a surface of the platform. The platform may rotate about a guide axis with respect to the bogie system, and the plurality of seats may rotate about the guide axis with the platform.

20 Claims, 8 Drawing Sheets

(56) References Cited

U.S. PATENT DOCUMENTS

| | | | | |
|---|---|---|---|---|
| 2009/0272289 | A1* | 11/2009 | Baker | A63G 27/02 104/76 |
| 2012/0149480 | A1 | 6/2012 | Crawford et al. | |
| 2013/0059670 | A1* | 3/2013 | Crawford | A63G 4/00 472/36 |
| 2013/0087066 | A1 | 4/2013 | Crawford et al. | |
| 2013/0255530 | A1* | 10/2013 | Willcox | A63G 1/08 104/75 |
| 2016/0287999 | A1* | 10/2016 | Boyle | A63G 21/06 |

OTHER PUBLICATIONS

PCT/US2016/025289 Search Report and Written Opinion dated Jun. 8, 2016.

* cited by examiner

ROTATING PLATFORM COASTER

CROSS REFERENCE TO RELATED APPLICATIONS

This application claims priority from and the benefit of U.S. Provisional Application Ser. No. 62/827,690, entitled "ROTATING PLATFORM COASTER," filed Apr. 1, 2019, which is hereby incorporated by reference in its entirety for all purposes.

FIELD OF DISCLOSURE

The present disclosure relates generally to the field of amusement parks. More specifically, embodiments of the present disclosure relate to systems and methods utilized to provide amusement park experiences.

BACKGROUND

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Amusement parks often include attractions that incorporate simulated competitive circumstances between attraction participants. For example, the attractions may have cars or trains in which guests race against one another along a path (e.g., dueling coasters, go carts). Incorporating the competitive circumstances may provide an additional entertainment value to the guests, as well as increase variety for guests utilizing the attraction multiple times. However, certain systems may include multiple track sections to create the simulated competitive circumstances, thereby increasing the cost and complexity of the attraction. It is now recognized that it is desirable to provide improved systems and methods for simulated racing attractions that provide enhanced excitement for guests.

BRIEF DESCRIPTION

Certain embodiments commensurate in scope with the originally claimed subject matter are discussed below. These embodiments are not intended to limit the scope of the disclosure. Indeed, the present disclosure may encompass a variety of forms that may be similar to or different from the embodiments set forth below.

In accordance with one embodiment, an apparatus for an amusement park includes a bogie system configured to move along a ride path, a platform coupled to the bogie system, where the platform is configured to rotate about a guide axis with respect to the bogie system, and a plurality of seats coupled to a surface of the platform and configured to rotate about the guide axis with the platform.

In accordance with another embodiment, a system includes a bogie system configured to direct motion along a ride path, a platform coupled to the bogie system, where the platform is configured to rotate about a guide axis with respect to the bogie system, a plurality of seats coupled to a surface of the platform and configured to rotate about the guide axis with the platform, a first actuator configured to rotate the platform about the guide axis, and a second actuator configured to rotate the platform about a tilt axis, wherein the tilt axis is oriented crosswise to the guide axis.

In accordance with another embodiment, a system includes a track defining a ride path, a bogie system coupled to the track, where the bogie system is configured to direct motion along the ride path, a platform coupled to the bogie system, where the platform is configured to rotate about a guide axis with respect to the bogie system, a first seat coupled to a surface of the platform and configured to rotate about the guide axis with the platform, and a second seat coupled to the surface of the platform and configured to rotate about the guide axis with the platform, where rotation of the platform adjusts a first position of the first seat and a second position of the second seat with respect to one another along the ride path.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
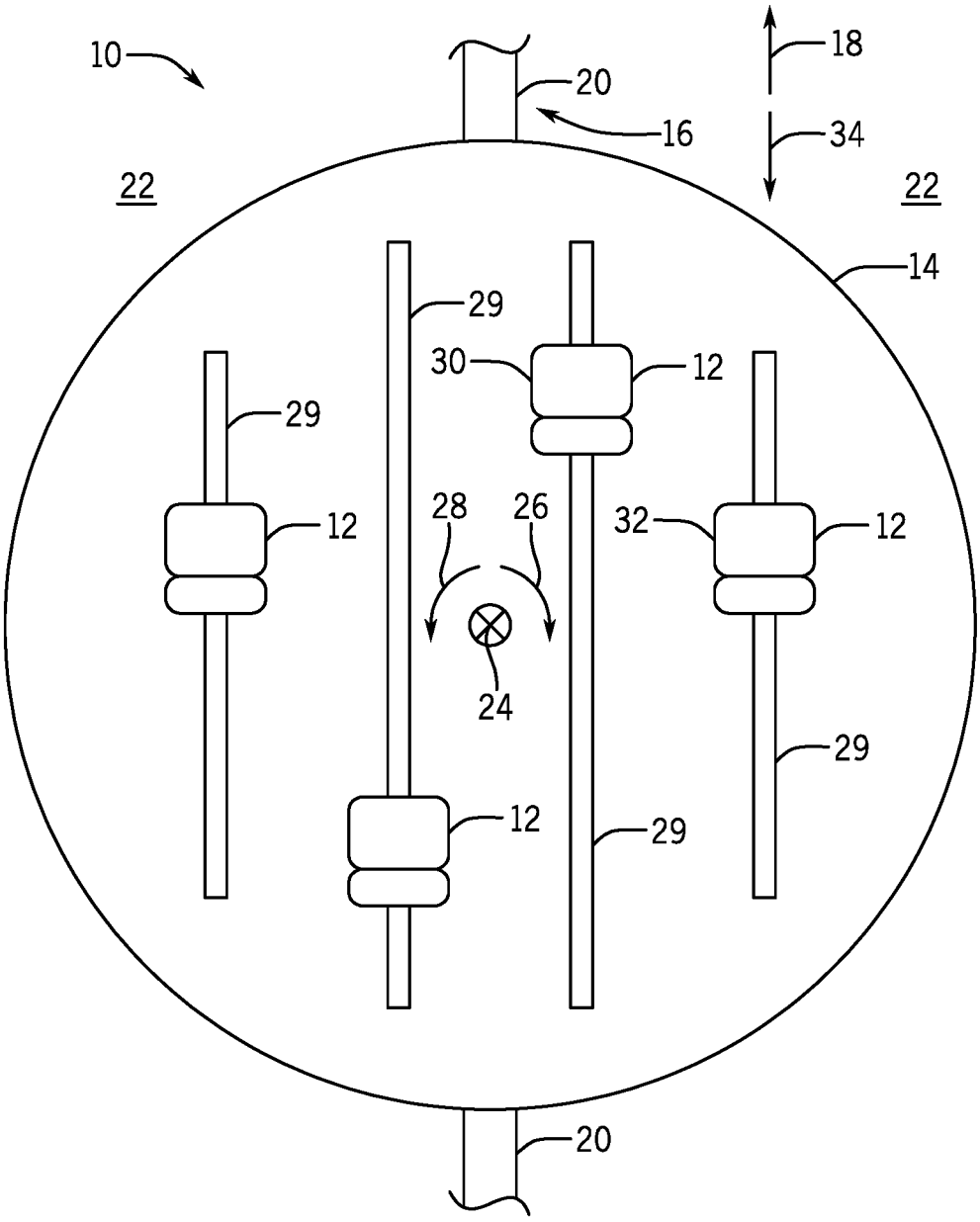
FIG. 1 is a plan view of an embodiment of a rotating platform ride vehicle, in accordance with an aspect of the present disclosure.

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Attractions at amusement parks that involve competitive circumstances (e.g., racing between riders) may be limited by the physical constraints of the footprint of the attraction and by the amount of control over the ride experience. For example, ride vehicles (e.g., go carts) on a multi-lane track may interact with each other but their interactions are typically based on individual riders and the nature of the experience will thus be limited (e.g., the vehicles are typically configured to run relatively slow in comparison to other amusement park rides). These isolated track sections (e.g., roller coaster tracks) may have individual ride vehicles for riders to occupy during the attraction. Unfortunately, the cost of constructing and operating the attraction may be elevated because of the multiple and isolated track sections. Additionally, the complexity of the control system associated with forming a competitive environment may increase because of the increased amount of variables that are associated with multiple isolated tracks each having individual ride vehicles. Further, having ride vehicles on separate track sections may make it difficult to simulate certain interactions (e.g., one ride vehicle passing another or sharing a lane with another ride vehicle) because the track sections would be required to merge or cross over one another.

Present embodiments of the disclosure are directed to facilitating a simulated competitive attraction, in a manner that gives guests the ability and/or the illusion of controlling the outcome of a competition (e.g., a race or a sporting event). As used herein, simulated competition may refer to directing a ride vehicle (e.g., a platform ride vehicle) along a track at variable speeds and enabling a position of seats (e.g., sub-vehicles) that secure guests within the ride vehicle to move with respect to one another. The ride vehicle may include multiple seats (e.g., pods, vehicles, or other features consistent with the theme of the simulated competitive attraction) that may be positioned on a platform configured to rotate with respect to a track or ride path along which the ride vehicle moves. In some embodiments, guests may lean or otherwise adjust their position to cause the platform to rotate. As such, the guests may perceive that movement of a particular guest causes that guest to be positioned in front of other guests with respect to the ride path. In other embodiments, rotation of the platform may be caused by guest interaction with various features positioned along the ride path (e.g., a track). For example, guests may utilize an interactive device on board the ride vehicle and point the device at targets positioned along the ride path, which may allow the guests to collect points when the device is appropriately positioned and/or activated. Guests that collect points may then interact with a feature (e.g., a button, a throttle, a pedal) on the ride vehicle to cause rotation of the platform. In still further embodiments, rotation of the platform may be independent of guest interaction and may occur at various points along the ride path.

Additionally, in some embodiments, the ride path (e.g., a track) may include dead ends that appear to guests as a break in the ride path, which may provide for enhanced excitement to the guests. The ride vehicle (e.g., platform ride vehicle) may approach the dead end in a first direction of movement and rotate to reorient the guests to face a second direction of movement, opposite the first direction of movement. The ride vehicle may then begin moving in the second direction of movement from the dead end along the ride path. Additionally or alternatively, dead ends in the ride path may simulate a boundary of a playing field or other suitable environment that is consistent with the simulated competitive attraction. As a non-limiting example, the ride path may be configured to move the guests proximate to a goal which is positioned at an outer boundary of a playing field. The guests may then attempt to score by making a gesture, using physical components (e.g., a ball), and/or interacting with simulated components (e.g., holograms or images) when positioned proximate to the goal.

Further still, in some embodiments, the ride vehicle (e.g., platform ride vehicle) may be configured to move along the ride path (e.g., track), rotate about an axis that is substantially crosswise to movement of the ride vehicle along the ride path, and/or tilt or move about an axis defining movement of the ride vehicle along the ride path. As such, the ride vehicle may be configured to have multiple degrees of movement to further enhance an experience of the guests. In some embodiments, the seats of the ride vehicle may include a gimbal system that may maintain a position (e.g., viewpoint or perspective) of the guests with respect to movement of the ride vehicle along the ride path (e.g., the guests continuously face the direction of movement of the ride vehicle). For instance, actuators controlling rings of the gimbal system may maintain a perspective or viewpoint of the guests in a direction of movement of the ride vehicle along the ride path. In other embodiments, the gimbal system may be utilized to create additional degrees of movement by moving the individual seats with respect to the platform during the simulated competitive attraction.

With the foregoing in mind, FIG. 1 illustrates a top view of an embodiment of a ride vehicle 10. The ride vehicle 10 includes seats 12 coupled to a platform 14, which is configured to move along a ride path 16 (e.g., a track) in an operation direction 18. While the illustrated embodiment of FIG. 1 shows a substantially straight ride path 16, in other embodiments the ride path 16 may be arcuate, circular, polygonal, or any other shape that may simulate a road or travel path (e.g., river). For example, the ride path 16 may include S-shaped bends and hair-pin turns to enhance the excitement provided to a rider during operation. In certain embodiments, the platform 14 may be coupled to the ride path 16 via bogies or rollers (e.g., wheels) configured to couple to a structure 20 (e.g., a rail, a track, or another suitable component) of the ride path 16 to allow movement along the ride path 16 in the operation direction 18. In still further embodiments, the structure 20 of the ride path 16 may be disposed in a slot or groove under a ground surface 22 (e.g., a manufactured race surface) such that the structure 20 of the ride path 16 is substantially hidden from view of the guests. In other words, the structure 20 may be blocked from view perspectives of the guests in the seats 12 by the ground surface 22.

In the illustrated embodiment of FIG. 1, the platform 14, and thus the seats 12, are configured to rotate about a guide axis 24 in a first rotation direction 26 (e.g., clockwise with respect to FIG. 1) and a second rotation direction 28 (e.g., counter-clockwise with respect to FIG. 1). As will be described in detail below, rotation of the seats 12 and the platform 14 about the guide axis 24 may enable adjustment of the position of the seats 12 relative to one another, thereby producing the illusion of one seat 12 moving ahead of another seat 12 in a race or other competitive scenario. Further still, rotation of the platform 14 about the guide axis 24 may shift a view perspective of the guests with respect to the ride path 16. It will be appreciated that while the illustrated embodiment includes four seats 12 positioned on the platform 14, in other embodiments there may be 1, 2, 3, 5, 6, 7, 8, 9, 10, or more than 10 of the seats 12.

Further, in some embodiments, the seats 12 may be configured to move with respect to the platform 14 along slots 29 formed within the platform 14. For example, the seats 12 may be coupled to gears, belts, wheels, and/or another suitable device that may enable movement of the seats 12 with respect to the platform 14 along the slots 29. The seats 12 may thus move along the slots 29 to provide another degree of movement. As such, the seats 12 may be directed along the slots 29 in order to change a position of the seats 12 with respect to one another and with respect to the ride path 16. For instance, a first seat 30 may be generally positioned in front of a second seat 32. However, the first seat 30 may be moved in a direction 34 opposite the operation direction 18 and the second seat 32 may be moved in the operation direction 18 with respect to the platform 14 to move the second seat 32 in front of the first seat 30 with respect to the ride path 16. As such, a position of any of the seats 12 may be adjusted to simulate a given seat 12 moving in front of or behind other seats 12 with respect to the ride path 16 and/or the operation direction 18. While the illustrated embodiment of FIG. 1 shows the slots 29 as linear, in other embodiments, the slots 29 may be curved, jagged, or include other features that move the seats 12 with respect to the platform 14.

Figure 2:
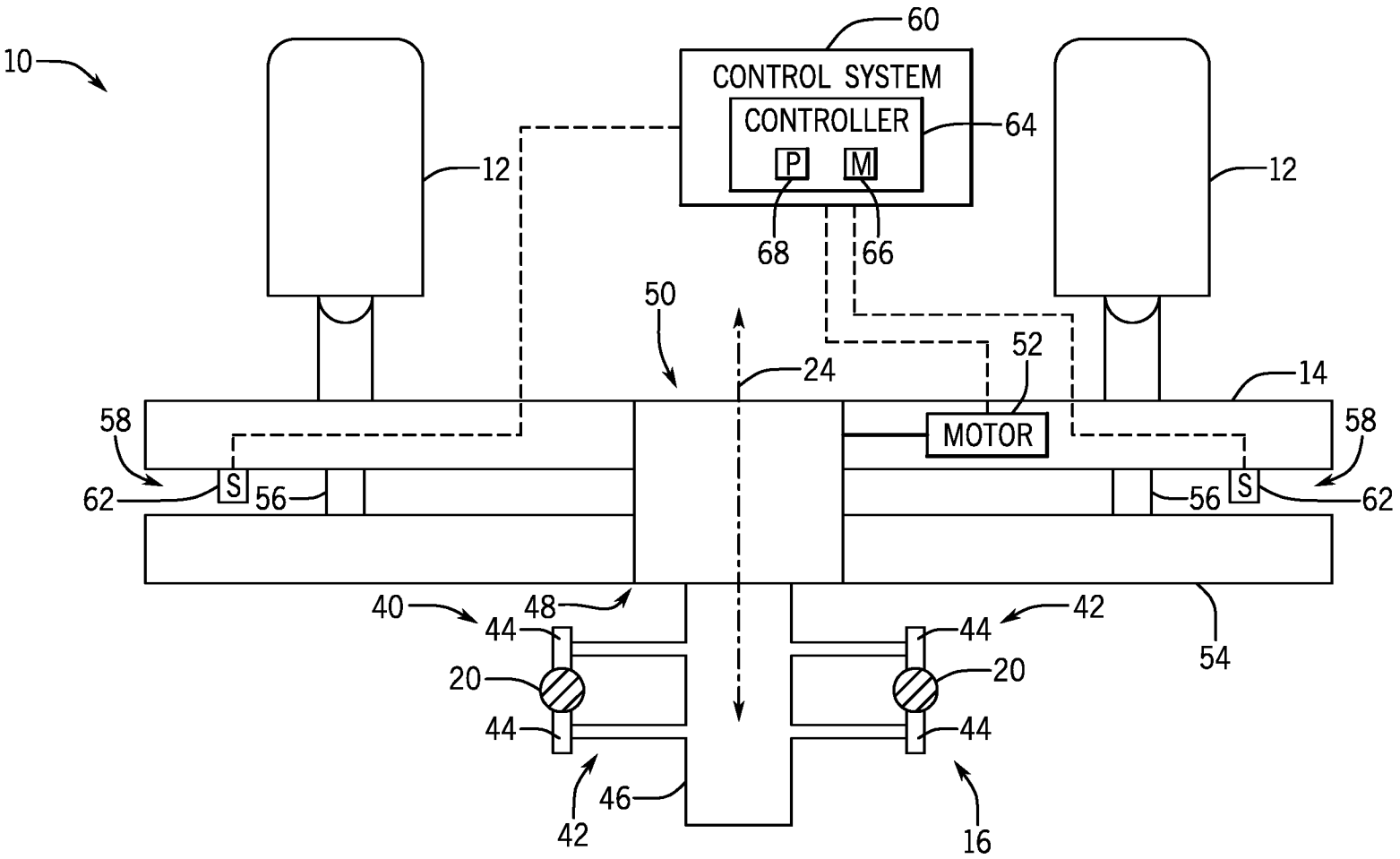
FIG. 2 is a cross-sectional elevation view of an embodiment of a motion system of the rotating platform ride vehicle, in accordance with an aspect of the present disclosure.

FIG. 2 is a cross-sectional side view of a motion system 40 configured to drive movement and/or rotation of the ride vehicle 10. The motion system 40 is movably coupled to the structure 20 (e.g., a pair of rails) of the ride path 16 via bogies 42. In certain embodiments, the bogies 42 may include or be coupled to motors (e.g., electric motors) that drive rotational movement of wheels 44 of the bogies 42 and propel the ride vehicle 10 along the ride path 16 in the operation direction 18 (and/or the opposite direction 34). Accordingly, the seats 12 and the platform 14 may travel along the ride path 16 to simulate a race or other competitive environment (e.g., a sporting event). In other embodiments, the bogies 42 may move along the structure 20 of the ride path 16 via gravitational forces and/or any other suitable technique for driving the ride vehicle 10 along the ride path 16. Furthermore, a body 46 of the bogies 42 is coupled to and supports the wheels 44. As will be appreciated, the body 46 of the bogies 42 may be formed from metals (e.g., steel), composite materials (e.g., including carbon fiber), or the like. In the illustrated embodiment, the body 46 is coupled to an actuator 48 that enables the platform 14 to rotate about the guide axis 24, thereby adjusting the circumferential position of the seats 12 with respect to the guide axis 24.

As shown in the illustrated embodiment of FIG. 2, the actuator 48 includes a gear assembly 50 and a motor 52 configured to drive rotational movement of the platform 14 about the guide axis 24. For example, the gear assembly 50 may be a yaw drive that transmits rotational movement between interlocking gears. In some embodiments, the platform 14 may be coupled to a guide 54 via the gear assembly 50 and one or more supports 56. The guide 54 is coupled to the bogies 42, and thus, is configured to move along the ride path 16 in the operation direction 18. A gap 58 may be formed between the guide 54 and the platform 14, which may reduce friction between the platform 14 and the guide 54 as the platform 14 rotates with respect to the guide 54. Also, in other embodiments, the actuator 48 may be a rotary actuator configured to drive rotation of the platform 14 upon receipt of a signal from a control system 60. Rotation of the platform 14 may adjust the position of the seats 12 relative to one another, thereby providing an illusion of one seat 12 passing another during a race or other competitive environment (e.g., sporting event).

In certain embodiments, the platform 14 includes sensors 62 configured to detect a circumferential position of the platform 14 with respect to the guide 54. As such, the sensors 62 may also be utilized to determine a circumferential position of the seats 12 with respect to the guide 54. For example, the sensors 62 may include Hall effect sensors, capacitive displacement sensors, optical proximity sensors, inductive sensors, string potentiometers, electromagnetic sensors, or any other suitable sensor. In certain embodiments, the sensors 62 are configured to send a signal indicative of a position of the platform 14 and/or the seats 12 to the control system 60 (e.g., local and/or remote). Accordingly, feedback from the sensors 62 may be utilized by the control system 60 to adjust the position of the platform 14 about the guide axis 24 (e.g., when rotation of the platform 14 is actuatable).

As mentioned above, the motion system 40 may include the control system 60 configured to control movement and/or rotation of the platform 14. The control system 60 includes a controller 64 having a memory 66 and one or more processors 68. For example, the controller 64 may be an automation controller, which may include a programmable logic controller (PLC). The memory 66 is a non-transitory (not merely a signal), tangible, computer-readable media, which may include executable instructions that may be executed by the processor 68. That is, the memory 66 is an article of manufacture configured to interface with the processor 68.

The controller 64 receives feedback from the sensors 62 and/or other sensors that detect the relative position of the motion system 40 along the ride path 16. For example, the controller 64 may receive feedback from the sensors 62 indicative of the position of the platform 14, and therefore the seats 12, with respect to the guide 54. Based on the feedback, the controller 64 may regulate operation of the ride vehicle 10 to simulate a race or other competition. For example, in the illustrated embodiment, the controller 64 is communicatively coupled to the motor 52 of the actuator 48. Based on feedback from the sensors 62, the controller 64 may instruct the motor 52 to drive rotation of the gear assembly 50, which may rotate the platform 14 and change the position of the seats 12 relative to one another.

Figure 3:
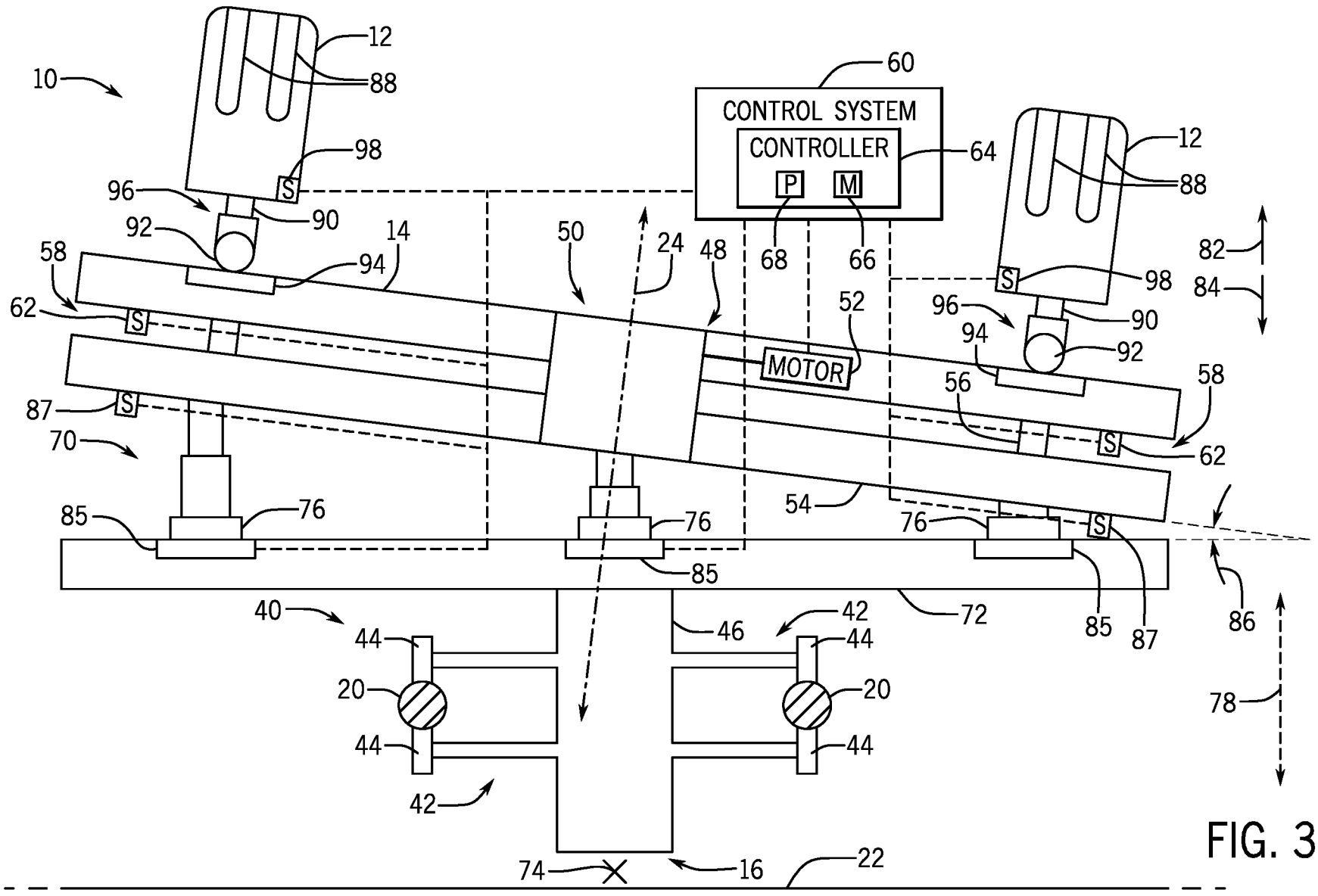
FIG. 3 is a cross-sectional elevation view of an embodiment of a motion system of the rotating platform ride vehicle, in accordance with an aspect of the present disclosure.

FIG. 3 is a cross-sectional side view of an embodiment of a pivoting motion system 70 that may be utilized to couple the platform 14 to the structure 20 of the ride path 16. In the illustrated embodiment, the platform 14 and the guide 54 are coupled to a pivot structure 72. The platform 14 may be driven to rotate about a ride path axis 74 via actuators 76 of the pivoting motion system 70. As a result, the guests within the seats 12 of the platform 14 may be positioned at different locations with respect to an axis 78 that is substantially crosswise to the ride path axis 74. In some embodiments, the pivoting motion system 70 may enable the platform 14 and/or the guide 54 to rotate about the ride path axis 74 when the ride vehicle 10 approaches a turn or curved portion of the ride path 16, thereby simulating a vehicle steering into the curve.

As shown in the illustrated embodiment of FIG. 3, the pivoting motion system 70 includes the pivot structure 72 that allows the platform 14 and the guide 54 to move in a first vertical direction 82 and/or a second vertical direction 84 via the actuators 76. For instance, the actuators 76 may include telescoping arms controlled by motors 85 that extend and retract in the first vertical direction 82 and the second vertical direction 84, respectively. As such, the actuators 76 may adjust a vertical position platform 14 and/or the guide 54. In some embodiments, some of the actuators 76 may be extended in the first vertical direction 82 while a position of other actuators 76 is substantially maintained. Accordingly, the platform 14 and/or the guide 54 may be positioned at an angle 86 with respect to the pivot structure 72 and/or the ground 22. The angle 86 may allow the platform 14 to be tilted to simulate the ride vehicle 10 steering into a curve or other feature of the ride path 16. While the illustrated embodiment of FIG. 3 shows the pivoting motion system 70 having three of the actuators 76, in other embodiments, the pivoting motion system 70 may include any suitable number of the actuators 76 (e.g., 1, 2, 3, 5, 6, 7, 8, 9, 10, or more than 10 of the actuators 76).

In some embodiments, the actuators 76 may be coupled to the controller 64, which may activate and/or deactivate one or more of the actuators 76 to move the platform 14 and/or the guide 54 in the first and second vertical directions 82, 84. The controller 64 may receive feedback from sensors 87 to determine a position of the platform 14 and/or the guide 54 with respect to the pivot structure 72, and send one or more signals to the actuators 76 to adjust the position of the platform 14 and/or the guide 54 to a desired location.

As shown in the illustrated embodiment of FIG. 3, the ride vehicle 10 includes the seats 12 for guests. The seats 12 may include restraints 88 (e.g., shoulder restraints, lap bars, seat belts) that secure the guests in the seats 12 as the ride vehicle 10 moves, rotates, and/or is otherwise manipulated throughout the duration of operation of the ride. In some embodiments, the seats 12 may be coupled to the platform 14 of the ride vehicle 10 via a respective base 90 and a respective joint 92. The joint 92 may allow rotation of the seats 12 with respect to the platform 14 of the ride vehicle 10 and/or the platform 14. For instance, an actuator 94 (e.g., motor) may be coupled to each joint 92 to adjust a position of a respective seat 12. In some embodiments, the seats 12 may be configured to maintain a position of the guests with respect to the structure 20 of the ride path 16 (or the ground 22) as the platform 14 moves and/or rotates throughout the duration of the ride. Additionally or alternatively, the seats 12 may be rotated independently of a position of the platform 14. Further still, the seats 12 may be linearly actuated from the platform 14 of the ride vehicle 10. For instance, each base 90 may include telescoping segments 96 coupled to the actuator 94, and thus, allow the seats 12 to move toward and away from the platform 14 of the ride vehicle 10.

In still further embodiments, the joint 92 between the base 90 and the seat 12 may rotate via interaction by the guests. For example, the guests may shift their weight to rotate the seats 12 with respect to the base 90. In some embodiments, guests shifting their weight may also cause the platform 14 to rotate and simulate a change in position of the guests (e.g., a change in which a guest appears to be in front of the remaining guests). The movement of the guests may physically cause the platform 14 to rotate about the guide axis 24. Additionally or alternatively, rotation of one or more of the seats 12 may be detected by sensors 98, which may cause the controller 64 to actuate the actuator 48 (e.g., the gear assembly 50 and the motor 52) to rotate the platform 14. Accordingly, interaction by the guests may ultimately cause rotation of the platform 14.

Figure 4:
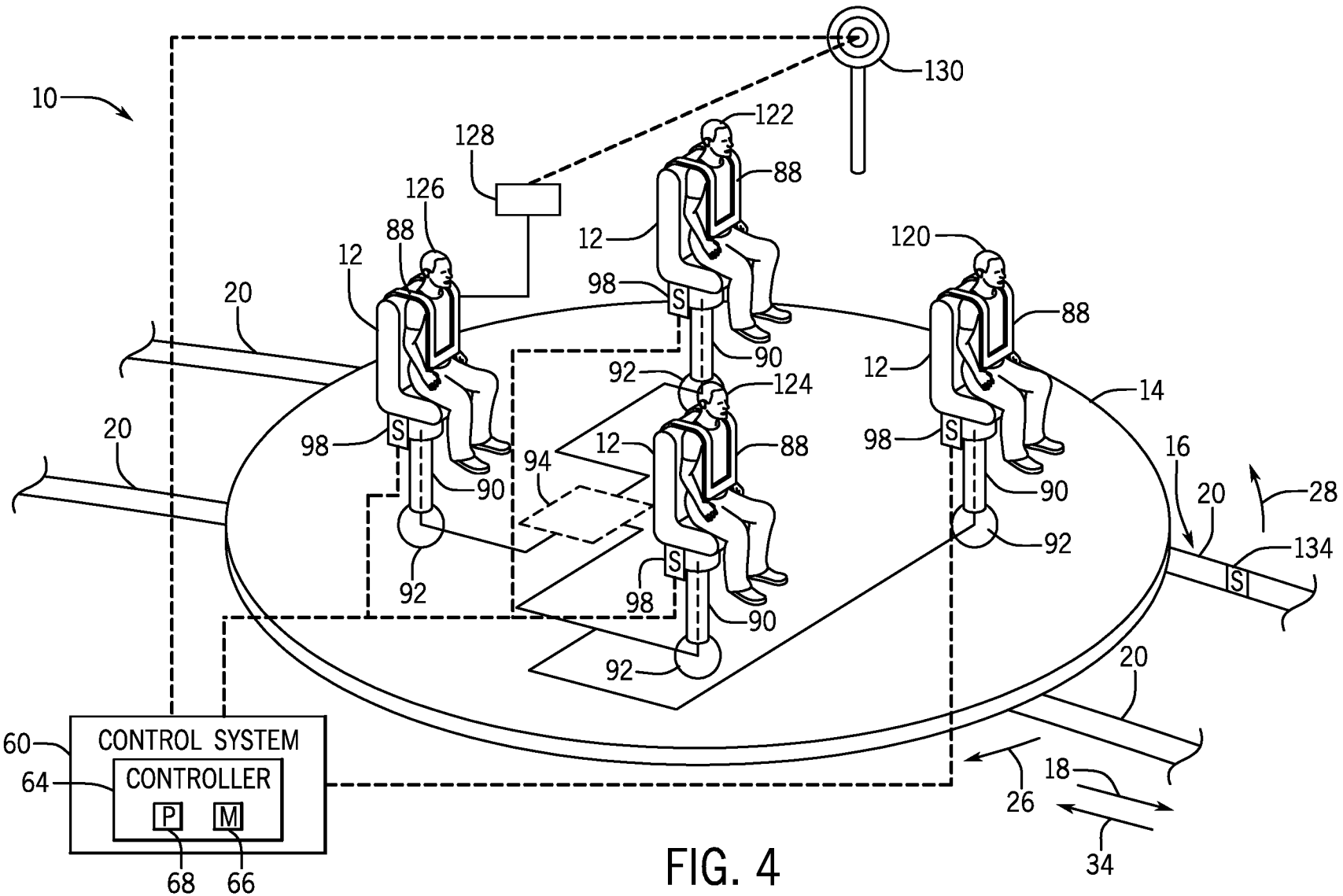
FIG. 4 is a perspective view of an embodiment of the rotating platform ride vehicle in a first position, in accordance with an aspect of the present disclosure.
Figure 5:
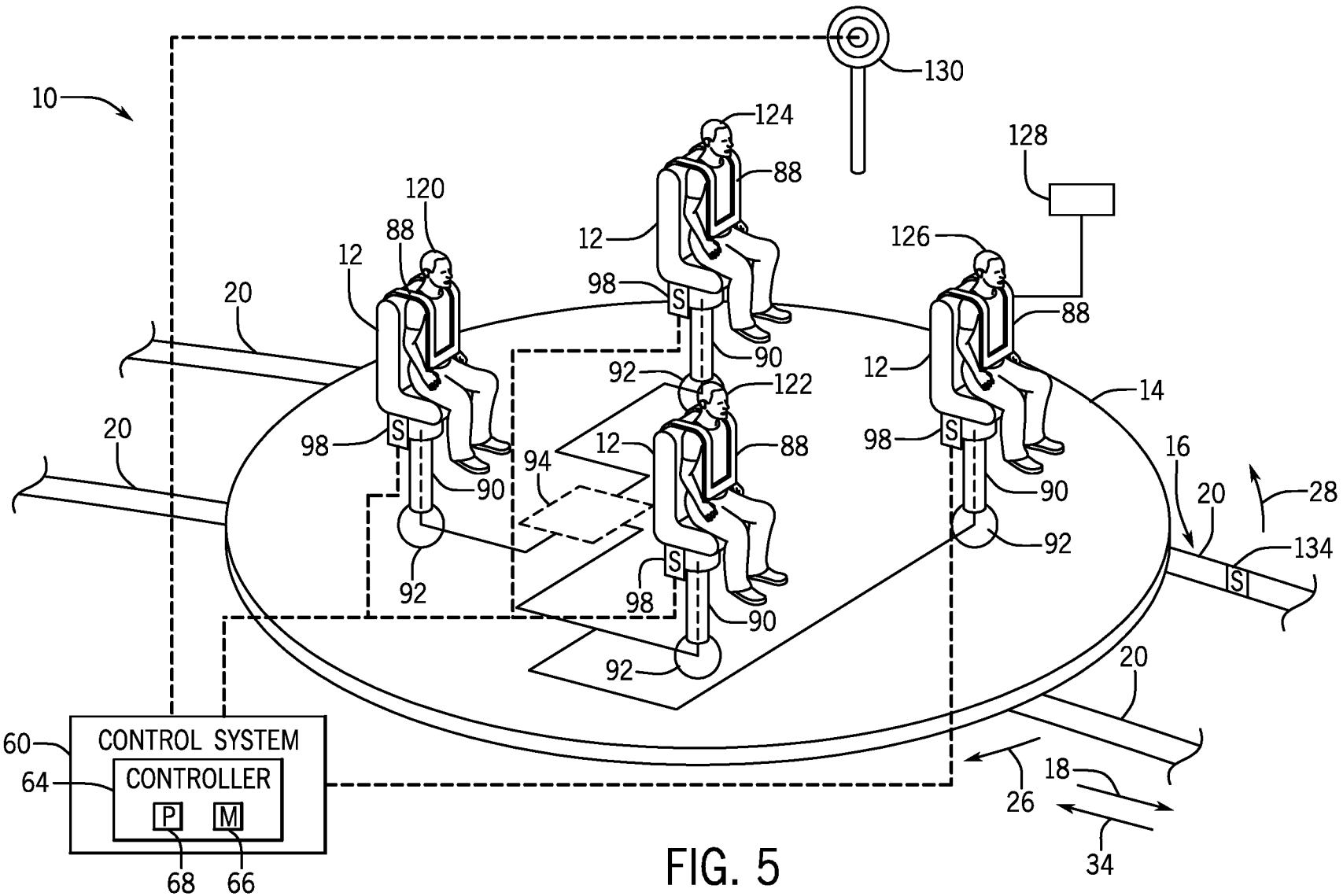
FIG. 5 is a perspective view of an embodiment of the rotating platform ride vehicle in a second position, in accordance with an aspect of the present disclosure.

FIGS. 4 and 5 are schematic diagrams of embodiments of the ride vehicle 10 illustrating rotation of the platform 14 as a result of interaction by the guests. As shown in the illustrated embodiment of FIG. 4, a first guest 120, a second guest 122, a third guest 124, and a fourth guest 126 are shown in first position, a second position, a third position, and a fourth position, respectively, with respect to the operation direction 18. As an example of the manner in which the illustrated ride vehicle 10 operates, the fourth guest 126 may tilt the seat 12 by shifting weight forward in the operation direction 18. The seat 12 may then tilt toward the operation direction 18, which may be detected by one of the sensors 98. The controller 64 receives feedback from the sensors 98 and may actuate rotation of the platform 14 in the first rotation direction 26 and/or the second rotation direction 28 in response to the feedback.

Additionally or alternatively, the fourth guest 126 may direct a component 128 (e.g., a handheld component, a component integrated with the seat 12, and/or another suitable device) toward a target 130 positioned along the ride path 16 to actuate rotation of the platform 14. As shown in the illustrated embodiment of FIG. 4, the fourth guest 126 may point or otherwise direct the component 128 toward the target 130. Additionally or alternatively, the fourth guest 126 may activate a feature (e.g., a light emitting diode) of the component 128 to interact with the target 130. The fourth guest 126 may collect points based on a position of the component 128 with respect to the target 130. For example, the fourth guest 126 may receive more points when directing the component 128 (e.g., a light beam emitted from the component 128) toward a midpoint of the target 130 than when directing the component 128 (e.g., a light beam emitted from the component 128) toward an outer perimeter of the target 130. The controller 64 may be communicatively coupled to the component 128, the target 130, and/or an intermediate device coupled to the component 128 and/or the target 130. The controller 64 may then actuate rotation of the platform 14 to place the first guest 120, the second guest 122, the third guest 124, and the fourth guest 126 into positions corresponding to a number of points collected by the respective guests. Further still, the guests 120, 122, 124, 126 may interact with an activator (e.g., a button, a pedal, or a throttle) upon collecting a target amount of points, which may then actuate rotation of the platform 14 to place the guest interacting with the activator into the first position.

As shown in FIG. 5, the fourth guest 126 may be moved into the first position as a result of interaction with the seat 12 and/or the target 130. Accordingly, the platform 14 rotated approximately (e.g., within 10% of, within 5% of, within 1% of) 180 degrees in the first rotation direction 26 or the second rotation direction 28 as compared to the position of the platform 14 illustrated in FIG. 4. While the discussion above generally focused on guest interaction causing rotation of the platform 14, in other embodiments, the rotation of the platform 14 may be based on a position of the platform 14 along the ride path 16. For example, the controller 64 may be configured to receive feedback from sensors 134 positioned along the ride path 16 to determine a position of the platform 14. The controller 64 may then actuate rotation of the platform 14 based on a position of the platform 14 with respect to the ride path 16 (e.g., upon detection of the sensors 134). In still further embodiments, rotation of the platform 14 about the guide axis 24 may be actuated as a result of guest interaction, a position of the platform 14 along the ride path, timing between a most recent rotation of the platform 14, an arbitrary parameter (e.g., random rotation), or a combination thereof.

Figure 6:
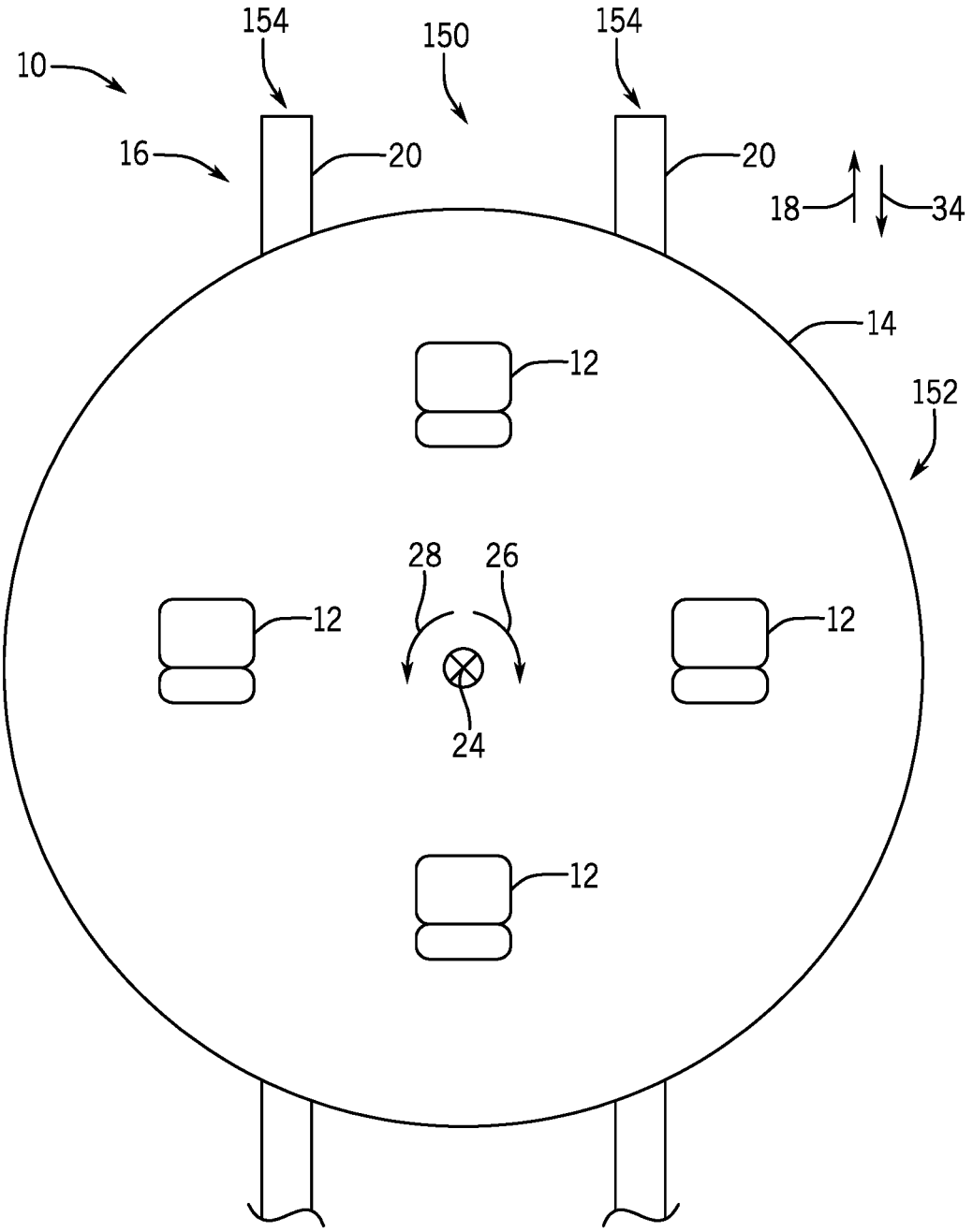
FIG. 6 is a plan view of an embodiment of the rotating platform ride vehicle at an end portion of a track, in accordance with an aspect of the present disclosure.

In some embodiments, the operation direction 18 of the platform 14 may change along the ride path 16. For instance, the ride path 16 may include a dead end 150 (e.g., an end or an interruption in the structure 20) that the platform 14 may reach when traveling along the ride path 16. FIG. 6 is a plan view of such an embodiment of the platform 14 being positioned at the dead end 150 in a first position 152. As shown in the illustrated embodiment of FIG. 6, the platform 14 is positioned proximate to a distal end 154 of the structure 20 (e.g., rails or tracks) of the ride path 16. Upon reaching the dead end 150, movement of the ride vehicle 10 and the platform 14 may be stopped, such that the ride vehicle 10 and the platform 14 are substantially stationary and facing the operation direction 18. In other words, the ride vehicle 10 and the platform 14 stop moving in the operation direction 18 along the ride path 16 when the ride vehicle 10 and the platform 14 reach a position proximate to the dead end 150.

Figure 7:
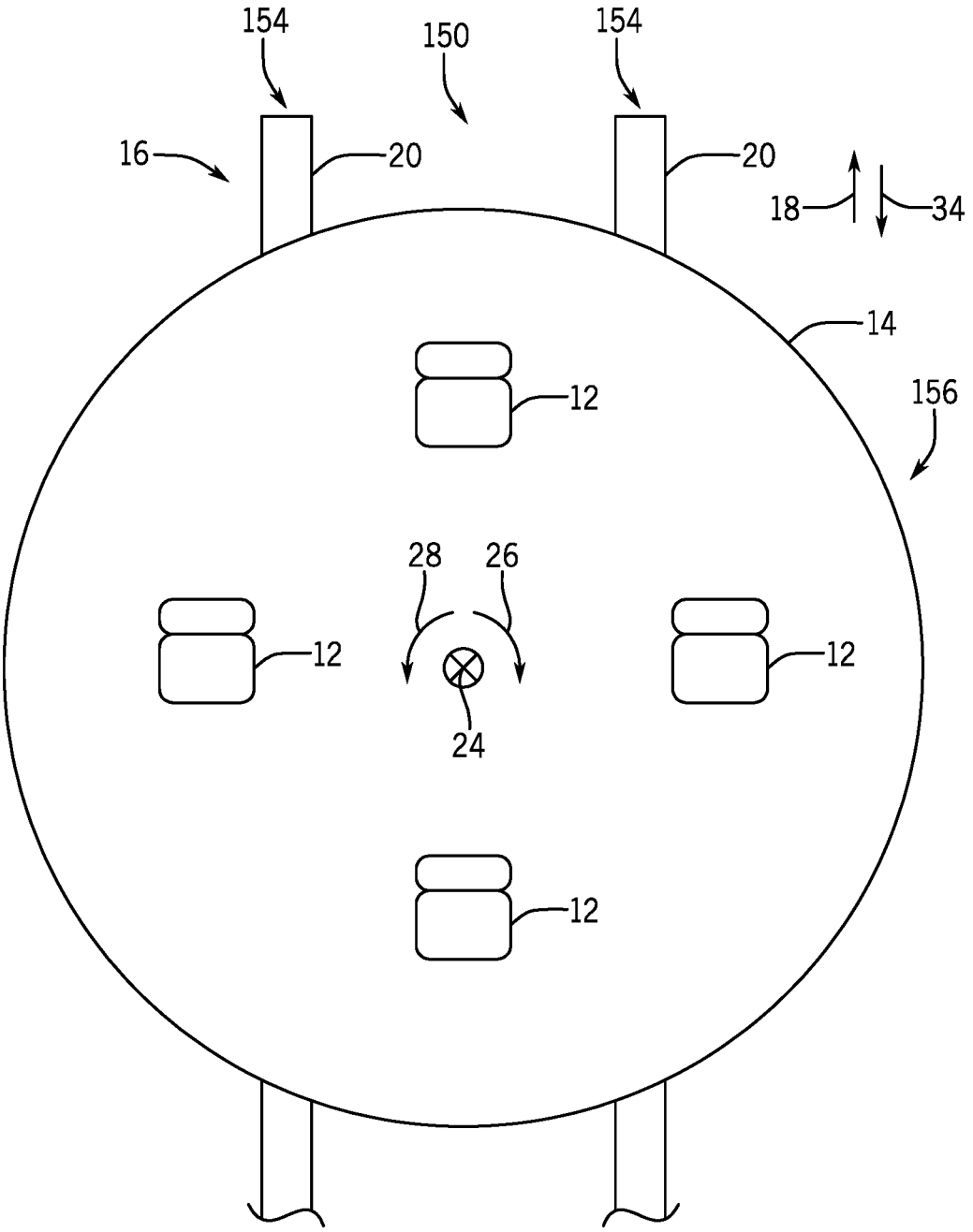
FIG. 7 is a plan view of an embodiment of the rotating platform ride vehicle at the end portion of the track, in accordance with an aspect of the present disclosure.

Upon stopping at the dead end 150, the platform 14 may rotate in the first rotation direction 26 or the second rotation direction 28 about the guide axis 24 to cause the platform 14 and the seats 12 to move toward a second position 156 facing the direction 34. For example, FIG. 7 is a top view of an embodiment of the ride vehicle 10, the platform 14, and the seats 12 facing the direction 34. As such, the platform 14 in the second position 156 is approximately (e.g., within 10% of, within 5% of, or within 1% of) 180 degrees from the first position 152 illustrated in FIG. 6. The platform 14 may thus rotate at the dead end 150 to reorient the seats 12 and enable the guests to face the direction 34. As such, the ride vehicle 10 may then move along the structure 20 of the ride path 16 in the direction 34 to move away from the dead end 150 and along the ride path 16. In other embodiments, the platform 14 may not rotate to reorient the seats 12 and to enable the guests to face the direction 34. As such, the guests may be facing the direction 18 as the ride vehicle 10 moves in the direction 34, which may provide enhanced excitement to the guests because the guests may not view a course of the ride vehicle 10.

The ride vehicle 10 may be directed toward the dead end 150 along the ride path 16 in the operation direction 18 and then redirected from the dead end 150 along the ride path 16 in the direction 34, opposite the operation direction 18. In some embodiments, the ride path 16 may include junctions and/or transitions that enable the ride vehicle 10 to be directed along a different structure 20 of the ride path 16 in the direction 34 as compared to movement in the operation direction 18. For instance, after reaching the dead end 150, the ride vehicle 10 may rotate and begin moving in the direction 34 toward a junction in the ride path 16. The ride vehicle 10 may transition to a different portion of the structure 20 of the ride path 16 as compared to a portion of the ride path 16 in which the ride vehicle 10 traveled to reach the dead end 150. Accordingly, the route of the ride vehicle 10 may not be the same when traveling toward and away from the dead end 150.

Figure 8:
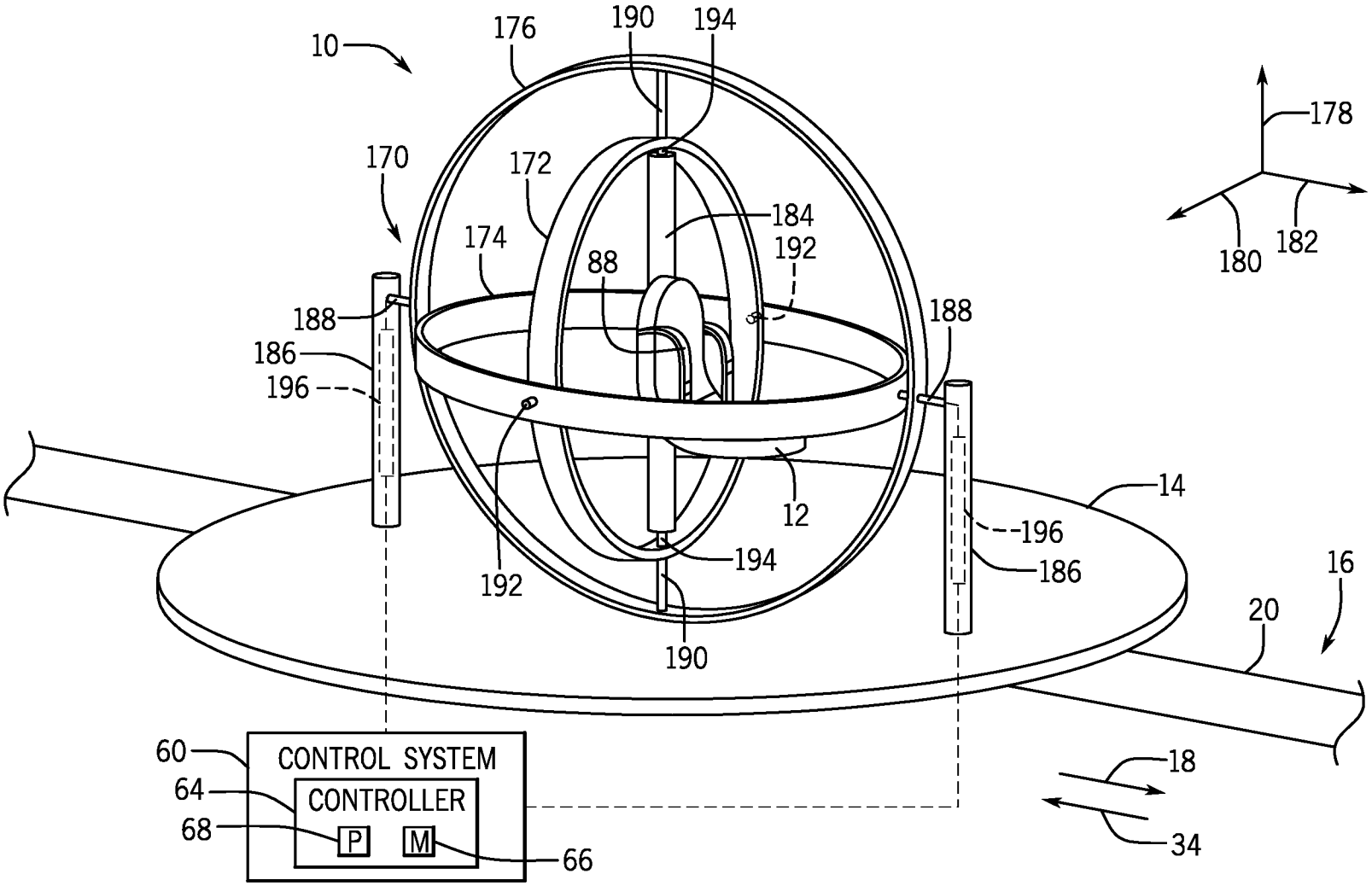
FIG. 8 is a perspective view of an embodiment of the rotating platform ride vehicle having a gimbal system, in accordance with an aspect of the present disclosure.

As discussed above, the seats 12 may be mounted to the platform 14 via a gimbal system to provide additional degrees of movement and/or to maintain a perspective of guests during at least a portion of the ride path 16. For instance, FIG. 8 is a perspective view of an embodiment of one of the seats 12 mounted to the platform 14 via a gimbal system 170. As shown in the illustrated embodiment of FIG. 8, the gimbal system 170 includes an inner ring 172, a middle ring 174, and an outer ring 176 that may each be configured to rotate about various axes. To facilitate discussion, the gimbal system 170 may be described with respect to a vertical axis 178, a lateral axis 180, and a longitudinal axis 182. In some embodiments, the inner ring 172 is configured to rotate about the vertical axis, the middle ring 174 is configured to rotate about the lateral axis 180, and the outer ring is configured to rotate about the longitudinal axis 182. In other embodiments, the inner ring 172, the middle ring 174, and the outer ring 176 may be configured to rotate about any suitable axis.

As shown in the illustrated embodiment of FIG. 8, the seat 12 is coupled to the inner ring 172 via a support beam 184, and thus, the seat is configured to move with the inner ring 172. Further, the outer ring 176 is coupled to supports 186 that are coupled to the platform 14. The outer ring 176 may be coupled to the supports 186 via rotatable joints 188 that facilitate rotation of the outer ring 176 about the longitudinal axis 182. Further, the middle ring 174 is coupled to the outer ring 176 via rotatable joints 190 that enable the middle ring 174 to rotate about the lateral axis 180. Further still, the inner ring 172 is coupled to the middle ring 174 via rotatable joints 192 to enable rotation of the inner ring 172 about the vertical axis. In some embodiments, the inner ring 172 is coupled to the support beam 184 via static joints 194 that do not enable movement of the support beam 184 and the inner ring 172 with respect to one another.

In some embodiments, the gimbal system 170 may include one or more actuators 196 (e.g., motors) that control rotation of the inner ring 172, the middle ring 174, and/or the outer ring 176. Accordingly, the controller 64 may be configured to actuate movement of the rings 172, 174, 176 as the ride vehicle 10 moves along the ride path 16. In some embodiments, the gimbal system 170 is configured to maintain a position of the seat 12 with respect to the ride path 16 and/or a direction of travel (e.g., the operation direction 18 and/or the direction 34) of the ride vehicle 10. In other embodiments, the gimbal system 170 is configured to move the seat 12 in any suitable direction or orientation to enhance an experience of the guests. As such, the controller 64 may control the actuators 196 to adjust the position of the seat 12 to provide an additional degree of movement to the ride vehicle 10.

While only certain features of the present disclosure have been illustrated and described herein, many modifications and changes will occur to those skilled in the art. It is, therefore, to be understood that the appended claims are intended to cover all such modifications and changes as fall within the true spirit of the present disclosure.

The invention claimed is:

1. An apparatus for an amusement park, comprising:

a bogie system configured to move along a ride path;

a platform coupled to the bogie system, wherein the platform is configured to rotate about a guide axis with respect to the bogie system;

a plurality of seats coupled to a surface of the platform and configured to rotate about the guide axis with the platform;

a sensor configured to detect a position of a seat of the plurality of seats with respect to the platform; and a controller configured to control rotation of the platform based on the position of the seat of the plurality of seats.

2. The apparatus of claim 1, wherein the platform comprises a slot, and wherein the seat of the plurality of seats is configured to move along the slot with respect to the platform.

3. The apparatus of claim 1, wherein the seat of the plurality of seats is rotatably coupled to the platform.

4. The apparatus of claim 1, wherein the sensor is configured to detect a position of the platform with respect to the ride path, and wherein the controller is configured to receive feedback indicative of the position of the platform from the sensor.

5. The apparatus of claim 4, wherein the controller is configured to control the rotation of the platform about the guide axis based on the feedback from the sensor.

6. The apparatus of claim 1, wherein the seat of the plurality of seats is coupled to the platform via a gimbal system.

7. The apparatus of claim 6, wherein the gimbal system is configured to maintain a position of the seat of the plurality of seats with respect to the ride path.

8. The apparatus of claim 1, comprising:

an interactive component configured to be handled by a guest positioned the seat of the plurality of seats; and a target positioned along the ride path and configured to be activated by the interactive component, wherein the controller is configured to:

receive feedback from the interactive component, the target, or both upon activation of the interactive component; and control the rotation of the platform about the guide axis based on the feedback.

9. The apparatus of claim 1, wherein the platform comprises a plurality of slots, and wherein each seat of the plurality of seats is configured to move along a respective slot of the plurality of slots.

10. The apparatus of claim 9, wherein each seat of the plurality of seats is configured to move along the respective slot independent from other seats of the plurality of seats.

11. A system, comprising:

a bogie system configured to direct motion along a ride path;

a platform coupled to the bogie system, wherein the platform is configured to rotate about a guide axis with respect to the bogie system;

a plurality of seats coupled to a surface of the platform and configured to rotate about the guide axis with the platform;

a first actuator configured to rotate the platform about the guide axis;

a second actuator configured to rotate the platform about a tilt axis, wherein the tilt axis is oriented crosswise to the guide axis;

a sensor configured to determine a position of a seat of the plurality of seats with respect to the platform; and a controller configured to control the first actuator, the second actuator, or both, based on the position of the seat of the plurality of seats with respect to the platform.

12. The system of claim 11, wherein the first actuator comprises a gear assembly driven by a motor.

13. The system of claim 11, wherein the second actuator comprises a pivot assembly having a pivot structure and a plurality of telescoping actuators coupled to the pivot structure.

14. The system of claim 11, wherein the controller is configured to control the first actuator and the second actuator based on a position of the platform with respect to the ride path.

15. The system of claim 11, wherein the seat of the plurality of seats is rotatably coupled to the platform.

16. The system of claim 11, wherein the platform comprises a third actuator configured to move the seat of the plurality of seats away from the platform, toward the platform, or both.

17. The system of claim 16, wherein the seat of the plurality of seats comprises a base having a telescoping segment coupled to the third actuator that enables the seat of the plurality of seats to move away from the platform, toward the platform, or both.

18. A system for an amusement park, comprising:

a track defining a ride path;

a bogie system coupled to the track, wherein the bogie system is configured to direct motion along the ride path;

a platform coupled to the bogie system, wherein the platform is configured to rotate about a guide axis with respect to the bogie system;

a first seat coupled to a surface of the platform and configured to rotate about the guide axis with the platform;

a second seat coupled to the surface of the platform and configured to rotate about the guide axis with the platform;

a sensor configured to determine a first position of the first seat, a second position of the second seat, or both with respect to the platform; and a controller configured to control rotation of the platform based on the first position of the first seat, the second position of the second seat, or both.

19. The system of claim 18, wherein the track comprises a dead end, and wherein the bogie system is configured to move toward the dead end in a first direction and away from the dead end in a second direction, opposite the first direction.

20. The system of claim 19, wherein the platform is configured to rotate approximately 180 degrees with respect to the bogie system upon reaching the dead end.

* * * * *